United States Patent [19]

Armitage

[11] 4,319,106

[45] Mar. 9, 1982

[54] PUSH BUTTON SWITCH

[76] Inventor: Ralph T. Armitage, 5 Woodward Ave., Gloucester, Mass. 01930

[21] Appl. No.: 136,150

[22] Filed: Mar. 31, 1980

[51] Int. Cl.[3] ..... H01H 13/56

[52] U.S. Cl. ..... 200/153 J; 200/153 L; 200/160

[58] Field of Search ..... 200/153 J, 153 L, 153 LB, 200/156, 160

[56] References Cited

U.S. PATENT DOCUMENTS

| | | | |
|---|---|---|---|
| 1,842,264 | 1/1932 | Greter | 200/153 J |
| 2,810,049 | 10/1957 | Hutt | 200/155 R |
| 2,899,931 | 8/1959 | Bross | 120/22 |
| 2,905,147 | 9/1959 | Johmann | 120/42.03 |
| 2,954,701 | 10/1960 | Beril | 74/126 |
| 3,161,070 | 12/1964 | Venables | 74/129 |
| 3,223,072 | 12/1965 | Bross | 120/42.03 |
| 3,226,991 | 1/1966 | Hartsock | 74/161 |
| 3,388,605 | 6/1968 | Schafer | 74/88 |
| 3,422,941 | 1/1969 | Fredell | 192/12 |
| 3,437,775 | 4/1969 | Piber | 200/153 J |
| 3,523,168 | 8/1970 | Holmes | 200/153 J |
| 3,587,333 | 6/1971 | Duncan | 74/88 |
| 3,827,308 | 2/1974 | Brown | 74/88 |
| 4,175,222 | 11/1979 | Buttner | 200/160 |
| 4,225,765 | 9/1980 | Johnston et al. | 200/156 |

FOREIGN PATENT DOCUMENTS

| | | | |
|---|---|---|---|
| 900299 | 7/1962 | United Kingdom | 120/42.03 |
| 915522 | 1/1963 | United Kingdom | 120/42.03 |

*Primary Examiner*—Willis Little

*Attorney, Agent, or Firm*—Hamilton, Brook, Smith & Reynolds

[57] ABSTRACT

An alternate action push button switch of the type in which longitudinal motion of a push button is converted to alternate circumferential rotation of a rotor means is provided to produce alternate opening or closing of a contact.

13 Claims, 7 Drawing Figures

PUSH BUTTON SWITCH

DESCRIPTION

Technical Field

This invention relates to subminiature electrical switches.

Background Art

Previous mechanisms for providing an on/off switch necessitated the conversion of a longitudinal reciprocation of a push button to a step rotation of a rotating member and employed complex and bulky and expensive mechanisms such as a pawl engageable with one of the teeth of a rotor. Another mechanism used a ratchet spring loaded and bearing against another ratchet which in turn was movable along the axis of the first ratchet. A cam on the second ratchet operated as a stop to prevent rotation of the spring loaded ratchet until the spring loaded ratchet was moved in some way to allow partial rotary motion to take place in the first ratchet.

Invention Disclosure

This invention discloses a new on/off subminiature switch for providing alternate opening and closing of an electrical contact upon longitudinal movement of a push button actuator. The mechanism for connecting the longitudinal motion of the push button to a stepped rotary detect position is similar to the mechanism previously employed in a protraction-retraction mechanism for ball point pens as may be found in U.S. Pat. No. 2,905,147 issued Sept. 22, 1959 to Fraub T. Johmann. However, certain important improvements were made to such mechanism, as will be subsequently described, to adapt such mechanism to the operation of the on/off switch of this invention. This switch contains a tubular housing member coaxially disposed in fixed relationship within a metal case. The tubular rotor housing member has a series of slots, 2N in number, disposed along the inner wall surfaces of the housing member. The depth of the slots alternates between one of two predetermined lengths $L_1$ and $L_2$. A tubular rotor actuator is coaxially disposed within the rotor housing member in a nonrotatable but longitudinally slideable relationship with the housing member. The rotor actuator member has 2N equally spaced teeth or lobes extending longitudinally from the rotor actuator member and N ears extruding radially from the member and engaged in every other slot in the housing member.

A tubular rotor which is partially rotatable circumferentially and is also longitudinally slideable in the rotor housing is provided with 2N equally spaced teeth also extending in a longitudinal direction but in opposition to the teeth in the rotor actuator. The rotor also has N radially extending ears engaged in every other slot in the housing. The opposing surfaces of the teeth in the respective rotor member and rotor actuator are designed to meet at an angle such that upon longitudinal movement of the rotor actuator when the push button is actuated the rotor member will slide along the inner wall surface of the rotor housing whereupon as the rotor actuator is further engaged within the housing, the rotor member becomes free to rotate circumferentially within the rotor housing until the opposing surfaces of the teeth on the rotor member fully mesh. This rotation describes an arc of about 15° and is caused by the torsional forces created by the teeth meeting at an angle. Next, when the push button is released the actuator is disengaged from the rotor, the rotor teeth are now free to describe 45° arc by sliding along an inclined surface of the inner wall of the housing until the bottom of a slot is reached.

Since the slots alternate in depth, two different fixed positions of the rotor are established in a longitudinal direction depending upon sequential displacement of the push button actuator.

A first spring is disposed within a base, said base being integrally coupled to a case which is in turn coaxially fixed to the rotor housing. This first spring exerts a force in opposition to the longitudinal movement of the rotor member. A substantially planar shorting contact is disposed at one end of the spring and adjacent to a pair of terminals. Thus, when the push button is actuated in a longitudinal direction the rotor member will rotate 360°/2N or 60° until it reaches the bottom of one of the slots whereupon the contact will either short the two terminals or open connection between the two electrical terminals. There is thus provided a relatively simple mechanism for causing an electrical connection to be made in one longitudinal motion of a push button switch in the next sequential longitudinal motion of said switch the contact is open.

Means may also be provided whereby a second spring is coupled intermediate said first spring and the base in opposition to the force of said first spring. The maximum longitudinal movement of the push button in said rotor housing is fixed at a predetermined distance; such that, on one stroke of the longitudinal motion of the push button the shorting contact will be moved against the terminals and the first spring will be compressed in opposition to the second spring. Thus, when wear occurs in the contact of the terminal the force of the second spring against the first spring will cause the contact member to move a sufficient distance to offset the wear in either the contact or the terminal. It may thus be seen that the alternate action push button switch mechanism of this invention has many outstanding advantages. It has few moving parts. It can accommodate wear in the contact or terminal. It is easy to fabricate and is low in cost and optimized for fabrication in very small diameter and length sizes.

BEST MODE CONTEMPLATED

Figure 1:
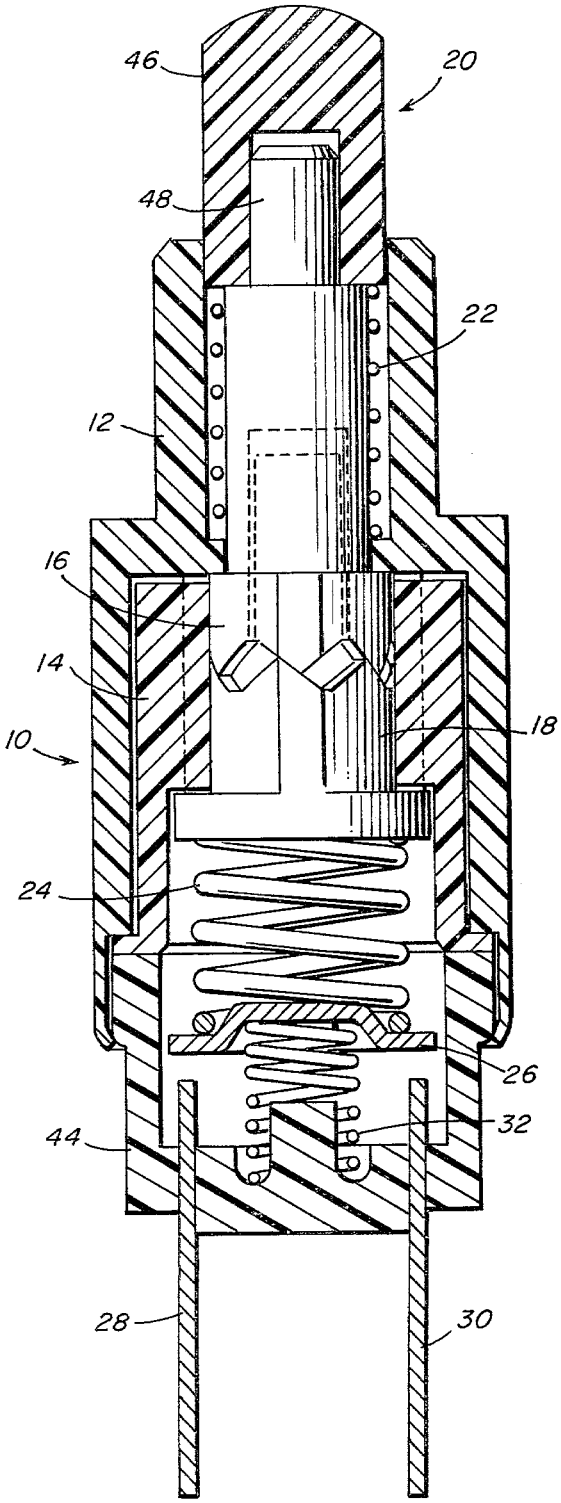
FIG. 1 is a sectional view of the push button switch during an interval where the push button is not engaged.

This invention can be further described by referring to the Figures in more detail. FIGS. 1–6 show one embodiment of push button switch of the invention shown generally at 10 in FIGS. 1 and 2. A tubular metalic casing member 12 is disposed coaxially about a plastic rotor housing 14 securing the housing in a nonrotatable fixed location. A plastic insulating base 44 is disposed within said housing at one end thereof. The end of case 12 is swaged to base 44 maintaining the base and housing in a fixed relationship to one another. There is thus provided a totally insulated area with no air leakage gaps to ground, in which to dispose the electrical switch contacts as will be described below. The tubular housing member 14 has a series of six equally spaced grooves or slots 34 cut into the inner wall surface 36 of the rotor housing as can be seen more clearly in FIGS. 4 or 5 and 6. The depth of the slots 34 alternate between lengths $L_1$ and $L_2$ wherein $L_1 < L_2$.

At the end of the housing opposite to the base end a rotor actuator 16 is disposed coaxially within the rotor housing member. The rotor actuator 16 is allowed to slide on three ears 17 in a longitudinal direction within the $L_2$ slots of housing 14, but because of the length of these grooves in relation to the allowable longitudinal movement of the rotor actuator, the rotor actuator is not permitted to rotate circumferentially within housing 14.

Figure 3:
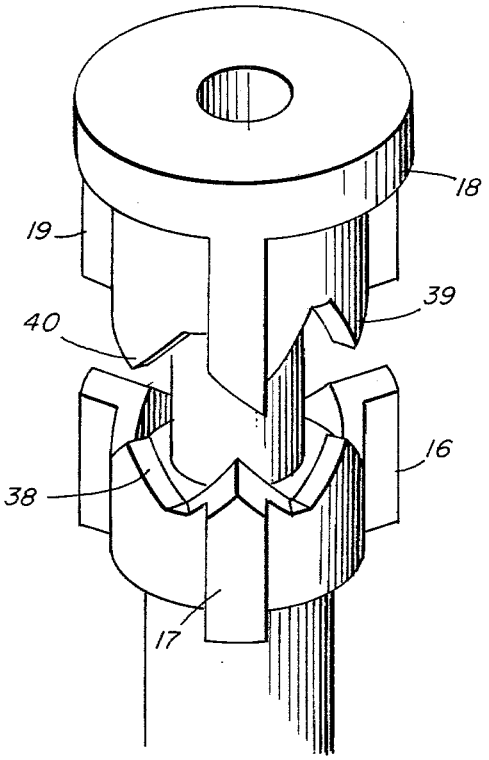
FIG. 3 is an exploded prospective view showing only the rotor and rotor actuator members of the push button switch.
Figure 4:
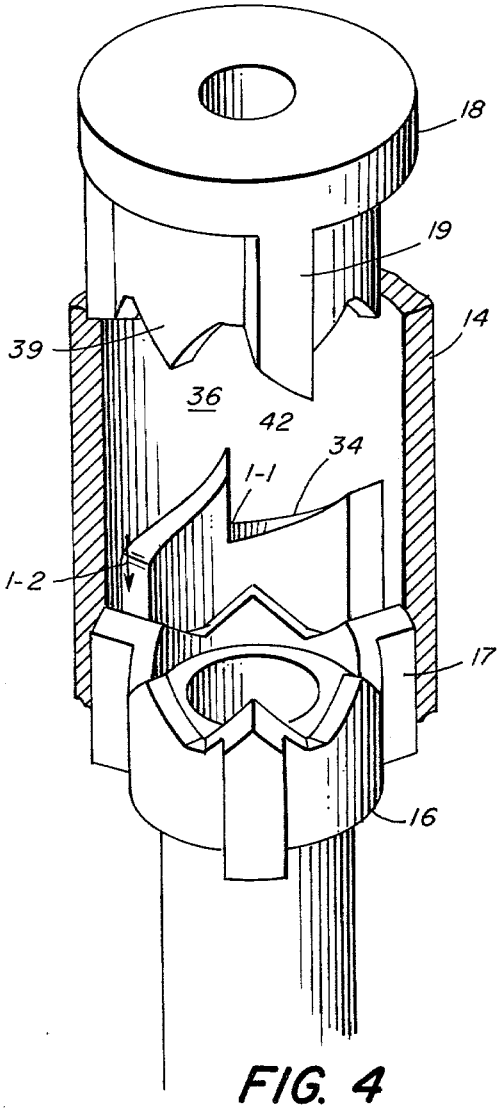
FIG. 4 is an exploded perspective view showing only the rotor, rotor actuator, and rotor housing of the push button switch.

As can be seen more clearly in FIGS. 3 and 4, the rotor actuator 16 has six equally spaced teeth 38 extending longitudinally from the rotor actuator. Each of these teeth have external surfaces which meet at an equal angle of about 100°. A tubular rotor member 18 is mounted on the rotor actuator. The rotor member also has six equally spaced teeth 39 with surfaces meeting at equal angles of about 100°. These teeth are disposed in opposing relationship to the teeth on rotor actuator 16. The rotor member 18 also has these radially protruding ears 19 which extend into, and are longitudinally slideably engaged with the $L_2$ slots of housing 14. The ears of the rotor are displaced with respect to the ears on the rotor actuator by approximately 26 thousandths of an inch where engaged in the rotor housing slots to prevent the opposing teeth from fully meshing in the non-engaged position of push button 20.

Rotor member 18 is thus free to move in a longitudinal direction sliding within rotor housing member 14 along deep slots $L_2$.

Referring back to FIGS. 1 and 2, spring 24 is disposed on the exterior planar surface of rotor 18 and exerts a force $F_1$ in opposition to the longitudinal movement of the rotor 18. At the other end of spring 24, a substantially planar shorting contact 26 is disposed in such a manner that it is able to move in a longitudinal direction when spring 24 is compressed (as shown in FIG. 2).

A second spring 32 is mounted at one end of base member 44 which is also provided with terminals 28 and 30 in fixed space relationship opposite shorting contact 26. Spring 32 has a spring force approximately one-third the force of spring 24 and exerts a force $F_2$ against shorting contact 26 in the opposite direction to the force $F_1$ exerted on shorting contact 26 from spring 24.

Figure 2:
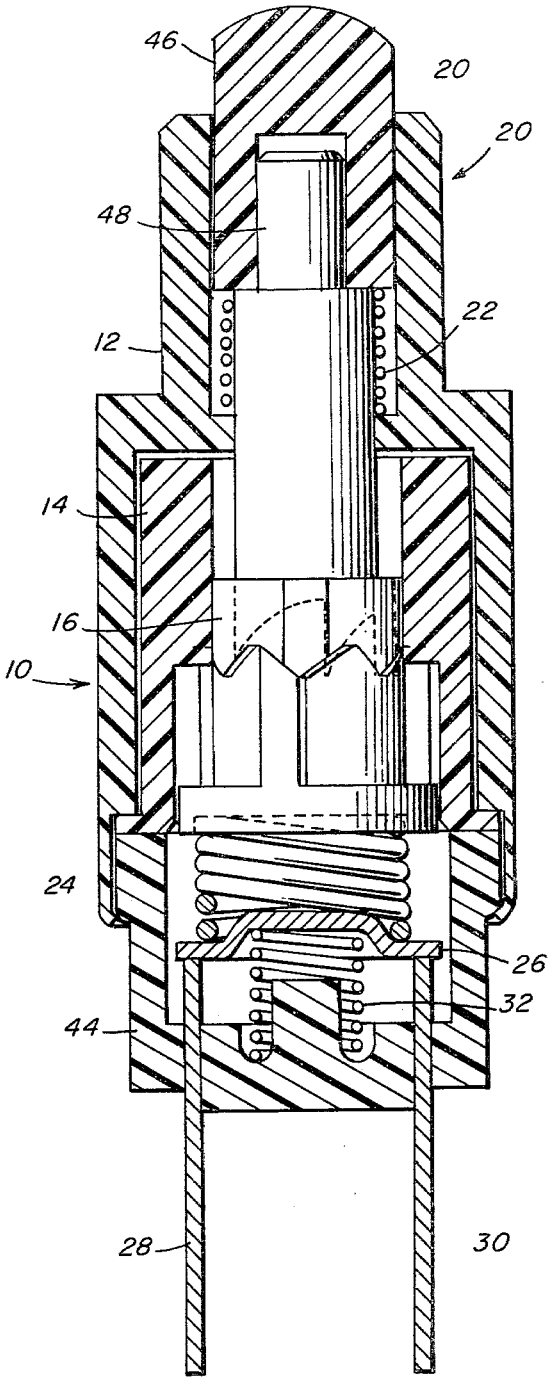
FIG. 2 is a sectional view of the push button switch showing the switch at a point in the movement of the button where the teeth on the rotor and rotor actuator are fully meshed.
Figure 5:
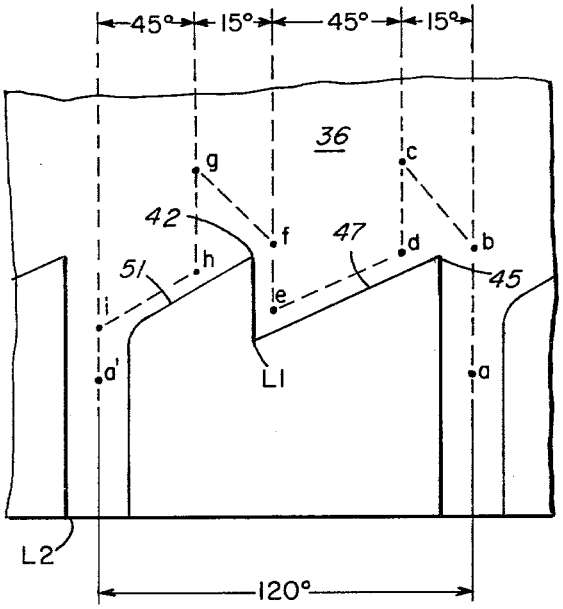
FIG. 5 is a planar view of a position of the inner wall surface of the rotor housing and also shows in schematic form, the rotation of the rotor 18.
Figure 6:
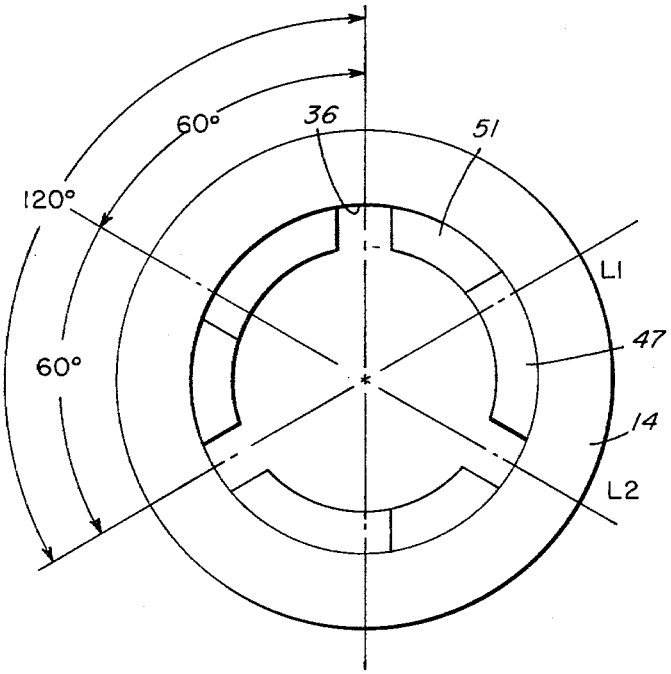
FIG. 6 is a cross-sectional view looking down the housing 14.

In the "on" movement of push button 20, the following reaction occurs as shown in FIGS. 2, 5 and 6. Spring 22 adjacent push button 20 is compressed. Rotor actuator 16 which is coupled to push button 20 moves longitudinally within housing 14. The opposing teeth of rotor actuator 16 and rotor housing 14 are engaged and rotor 18 moves longitudinally along the path a-b within rotor housing 14 thereby exerting a compressive force on spring 24.

Once the teeth 39 on rotor 18 clear the peak 45 of slot $L_2$ the rotor is free to rotate and the resultant vector caused by the opposing surface of the teeth 38 on the rotor actuator 16 meeting the teeth 39 on the rotor 18 causes the rotor to move along the line b-c an arc distance of about 15°. Next, as the push-button is disengaged, spring 22 which was compressed moves the push-button back. The rotor actuator slides back down the deep slots $L_2$ and the rotor ears 19 move along the line c-d until hitting the inclined slope surface 47 of housing 14. The rotor then slides down surface 47 on the ears 19 along the path d-e until the ears hit the wall surface 49 of the $L_1$ slot in housing 14. When the ears hit at $L_1$ (position "e") a distinct audible click occurs which is important to consumers of "on-off" switches. This sound may be enhanced by the choice of suitable hard plastic material for the rotor and rotor housing. Or, in the alternative the striking surfaces may be coated or clad with metal to produce an even more pronounced audible response.

When the rotor is in the position indicated at "e" in FIG. 5 the spring 24 is held compressed against shorting contact 26 so that contact is made across terminals 28 and 30 through shorting contact 26. Actually, spring 24 is compressed beyond that newly required to make contact and is held in that position when rotor 18 becomes locked in the $L_1$ slot of housing 14.

In order to move to an "off" position of switch 10, push button actuator 20 is again moved in a longitudinal direction causing the rotor actuator 16 to move rotor 18 out of its locked position in slot $L_1$ along the path e-f until it reaches peak 42 whereupon the rotor will be caused to move 15° circumferentially along the path f-g by the action of the displaced opposing teeth surfaces of the rotor and rotor actuator. In this position spring 24 is now decompressed thereby enabling shorting contact 26 under the spring force of spring 32 to move away from the terminals 28 and 30 causing this circuit to open up.

The various component members of switch 10 can be fabricated from a variety of materials. In a specific embodiment of the invention, the push button 20 is made from nylon and can be provided in a variety of colors as required for color coding or function identification in multiswitch applications. The base is made from diallyl phthalate. The terminals may be either printed circuit board type terminals or standard terminals. The contact is made from coin silver, silver plate over brass or gold over nickel plate over brass or other suitable contact material.

Then when the push button is released and the actuator slides back into the deep slot $L_2$ the rotor ear 19 moves from "g" to "h" and comes in contact with the slope of the housing and because of the mating angle and the slope of the housing surface 51 and the spring force $F_1$ from spring 24 the rotor moves an additional 45° along the path h-i thence back to a'.

Six teeth and three ears were employed on the rotor and rotor actuator in order to minimize the outer diameter of the switch mechanism. The more teeth and ears used the greater the outer diameter will have to be in order to provide room for the teeth. A unit with three ears engaged in slots or less also produces an advantage in that the rotor is enabled to travel in one stroke a distance of 360° divided by twice the number (N) of ears engaged in slots in the housing or in the three ear embodiment 60°. In a four ear structure, the arc described in one stroke would be 360°/8 or 45°. The greater the travel, the better the audible response is on impact owing to the greater velocity which can be attained before impact.

The rotor housing, the rotor actuator and the rotor may be fabricated from any suitable plastic materials such as thermoset or thermoplastic materials, for example, phenolic or nylon. A brass casing is employed to provide good electrical grounding.

Figure 7:
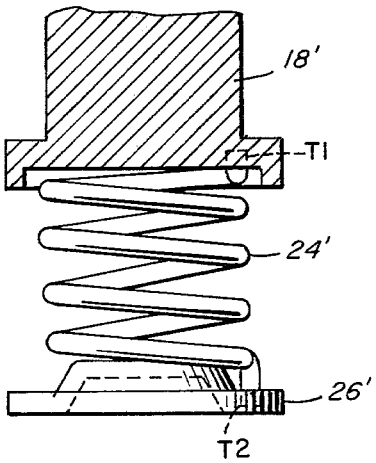
FIG. 7 is an exploded perspective showing an alternate embodiment of the rotor, spring and contact assembly.

An alternate embodiment of the invention is shown in FIG. 7 in which elements corresponding to those shown in FIG. 1 are labelled with a prime. In the apparatus of FIG. 7 only the rotor 18', spring 24' and contact 26' are shown, it being understood that all the other operative elements of FIG. 1 are incorporated by reference since they would remain unchanged.

In FIG. 7 spring 24 is provided with tangs on each end T1 and T2, which interfit with openings or indentations provided in the rotor 18' and the contact member 26'. This embodiment will provide a contact with a "wiping" action, for, each time the push button is depressed the rotor 18' rotates 60° causing contact member 26', which is now restrained by the tangs in spring 24' to follow the motion of the rotor, to likewise rotate 60° "wiping" against the contacts 30 and 28 of FIG. 1.

This wiping feature is a very desirable advantage since it reduces pitting and arcing and increases contact life.

Those skilled in the art will recognize or be able to ascertain using no more than routine experimentation many equivalents to the specific embodiments described herein. Such equivalents are intended to be covered by the following appended claims.

I claim:

1. A push button switch mechanism comprising:

a. a casing member;

b. a rotor housing member coaxially disposed in fixed relationship within said casing member and having 2N slots spaced along the inner wall surface of said rotor housing member, the depth of said slots alternating between different lengths $L_1$ and $L_2$;

c. a rotor actuator member coaxially disposed within said rotor housing member in substantially nonrotatable but longitudinally slideable relationship, said rotor actuator member having 2N equally spaced teeth extending in a longitudinal direction from said rotor actuator member and N radially extending ears engaged in alternate slots of said housing member;

d. a rotor member longitudinally slideable in said rotor housing member and having 2N equally spaced teeth extending in a longitudinal direction from said rotor member and N radially extending ears offset from the ears in said rotor actuator member and engaged in the same alternate slots of said housing member as the rotor actuator such that the teeth on the rotor member are not fully meshed with the teeth of the rotor actuator member until the ears on said rotor are beyond a predetermined longitudinal movement of said push-button;

e. the opposing surfaces of the teeth on the rotor member and the rotor actuator member meeting at an angle so that upon longitudinal movement of said rotor actuating member, the rotor member will slide along the inner wall of said rotor housing member up to a predetermined peak whereupon as the rotor actuator member is now caused to rotate until said teeth are fully meshed and where said push button is disengaged the rotor member will rotate until it comes to rest in the next adjacent slot within said housing member;

f. a push button coupled to said rotor actuating member;

g. a first spring exerting a force $F_1$ in opposition to the longitudinal movement of said rotor member;

h. a substantially planar shorting contact disposed at one end of said first spring;

i. a second spring exerting a force $F_2$ in opposition to the longitudinal movement in the rotor member;

j. at least two terminals disposed adjacent said planar shorting contact; and k. and a third spring exerting a force $F_3$ in opposition to the longitudinal movement of said push button.

2. The apparatus of claim 1 in which the shorting contact is caused to be displaced in one of two longitudinal positions depending upon the location of said rotor with respect to said slots.

3. The apparatus of claim 2 in which in one fixed position of the shorting contact the terminals are short circuited and in the other fixed position the terminals are open circuited.

4. The apparatus of claim 3 in which upon the next longitudinal movement of the push button the fixed position of the shorting contact is alternated from the previous fixed position of the shorting contact.

5. The apparatus of claim 1 in which N is an integer.

6. The apparatus of claim 1 in which N is an integer less than four.

7. The apparatus of claim 1 in which $F_2$ is less than $F_1$.

8. The apparatus of claim 1 in which $F_2$ is in the order of three times less than $F_1$.

9. The apparatus of claim 1 in which a metallic case surrounds the rotor housing and extends over the base member and is swaged thereto so as to compress the base member against an end of the rotor housing.

10. The apparatus of claim 9 in which the rotor housing and base member are insulators.

11. The apparatus of claim 1 in which the push button comprises a two piece molded plastic button and rod structure.

12. The apparatus of claim 1 in which the longitudinal travel of the rotor actuator exceeds the distance required to establish contact between the shorting contact and the terminals so that said second spring will be maintained in a predetermined compressed stages in the "on" position of said push button.

13. The apparatus of claim 1 in which the first spring has a pair of tangs one of which is inserted in said rotor member and the other of which is inserted in said planar shorting contact.

* * * * *